US005746152A

United States Patent [19]

Huse

[11] Patent Number: 5,746,152

[45] Date of Patent: May 5, 1998

[54] TELESCOPING SEAT PEDESTAL

[75] Inventor: O. C. Huse, Arlington, Tex.

[73] Assignee: Moeller Marine Products, Goodlettsville, Tenn.

[21] Appl. No.: 704,372

[22] Filed: Aug. 28, 1996

Related U.S. Application Data

[60] Provisional application No. 60/002,860, Aug. 28, 1995.

[51] Int. Cl. [6] ..... B63B 17/00

[52] U.S. Cl. ..... 114/363; 248/188.5; 297/344.18

[58] Field of Search ..... 114/363; 297/344.12, 297/344.18; 403/109, 377; 248/157, 161, 188.5

[56] References Cited

U.S. PATENT DOCUMENTS 3,741,514 6/1973 Snurr ..... 297/344.18

3,960,406 6/1976 Buker ..... 248/161

5,385,323 1/1995 Garelick ..... 403/109

*Primary Examiner*—Sherman Basinger

*Attorney, Agent, or Firm*—Howard & Howard

[57] ABSTRACT

The present invention discloses an improved vertically adjustable seat. The seat includes a guide post upon which an adjustable post is telescopically mounted. A spacer or engagement member is mounted between the guide post and the adjustable post to distribute forces applied to the seat over a broad area longitudinally extending between the adjustable post and the guide post. Additionally, the spacer member also provides frictional contact between the adjustable post and the guide post when the adjustable post is locked with respect to the guide post. In order to provide additional friction, a secondary engagement member is provided between the adjustable post and the guide post. This secondary engagement member provides greater friction at the point of locking to facilitate easy locking of the seat at a desired height.

19 Claims, 2 Drawing Sheets

TELESCOPING SEAT PEDESTAL

BACKGROUND OF THE INVENTION

This application claims priority to U.S. Provisional Application No. 60/002,860 filed Aug. 28, 1995, now abandoned, in the name of O. C. Huse.

The present invention primarily relates to pedestals for mounting boat seats within a boat and more particularly to pedestal seats that can be adjusted vertically to change the height of the seat.

In many boats, for example fishing boats, the seats are mounted on pedestals, which are typically made from aluminum tubes. One end of the tube is mounted to the deck of the boat through a mounting base and the other end has the seat mounted to it. The seat typically has a base with a flange that is mounted about the tube. In typical applications, the seat base swivels to allow the seat to turn through 360°.

In some seats, the pedestal can be adjusted vertically to allow the seat height to be raised and lowered. This type of pedestal typically has an inner post telescoped within an outer post. The outer post is mounted to the boat deck through a base and the inner post is mounted at one end to the boat seat with the other end inserted into the outer post. A clamp is mounted about the outer tube to squeeze the outer tube about the inner tube to prevent further movement of the inner tube when the seat is at the desired height. The clamp is generally a modified U-bolt that wraps around the outer tube. One end of the U-bolt is connected to a bracket and the other end extends through the bracket and has a nut that can be turned to tighten the U-bolt and bracket around the outer tube. The clamp normally has a long handle to provide leverage to facilitate tightening of the clamp around the outer tube.

A problem with this type of adjustable pedestal is the effort required to tighten the clamp to prevent further movement of the seat after the desired height has been selected. Since the clamp has to be tightened sufficiently to close the outer tube around the inner tube, a lot of force is required. Although the handle provides some mechanical advantage, it is still difficult to sufficiently tighten the clamp. If the clamp is not properly tightened, the seat can slip down or even become inoperable as an adjustable seat.

Another problem with the typical adjustable seat is the wear that occurs through use. This wear makes clamping increasingly difficult and results in an insecure feeling to the user because the seat begins to wobble. The pedestal experiences substantial wear at the clamping region because the clamping force acts in a circumferential line about the outer and inner tube. The forces acting on the seat are focused at this line contact and these forces are dynamic. It should be appreciated that the forces are dynamic forces because the weight of the user is shifting upon the seat due to the user's movements and the boat's motion. These dynamic forces are directed through the inner tube to the clamping area. This inner tube is wobbling in the outer tube because of these dynamic forces. This wobbling results in wear between the tubes and a loosening of the clamping forces. To compensate, more force must be applied to the clamp handle. As should be appreciated, this results in an ever increasing problem.

Another problem results from the effect of seat wobble. Because of the difficulty in getting a strong clamp between the telescoping tubes and because of the line contact that results, the user feels a shifting or wobbling of the seat. This shifting gets even more pronounced as the seat pedestal wears. This shifting and wobbling is magnified at the seat because of the distance between the seat and the clamping region and the line contact at the clamping region. Because of this magnification, the user feels like he is falling. Further, the reverse happens. As the user shifts, the shifting action is magnified and distributed at the clamping region with the inner tube rubbing against the outer tube, increasing the problem through use.

A still further problem is galling of the tubes. The continual shifting and wobbling causes the tubes to rub against one another marring their surfaces. This results in the tubes being unsightly and can lead to the tubes being welded or fused together. This makes further adjustment difficult and in some instances almost impossible.

SUMMARY OF THE INVENTION

The present invention overcomes the above problems. Briefly, the present invention provides a pedestal that resists wobbling and is easy to lock at the desired height. The pedestal has a telescoping post which is guided by a fixed guide post mounted inside the outer post. The guide post reduces wobble. To further reduce wobble an engagement member is positioned between the telescoping post and the guide post. The engagement member also facilitates locking and makes many actions easier and less expensive because tolerances can be opened.

The locking system is designed to ease locking of the seat at any desired position. The locking system is very simply constructed and relies upon an engagement member that distributes the forces longitudinally along the guide post to the base and a second engagement member used at the locking mechanism to further distribute locking forces.

More specifically, the pedestal of the present invention has a mounting means adapted for mounting the pedestal to a surface, such as a boat deck. The pedestal has an outer post which is supported in the mounting means. A guide post is mounted within the outer post and an adjustable post is mounted over the guide post and in the outer post for telescopic movement with respect to each. An engagement member is positioned between the guide post and the adjustable post to fill the space between the two to reduce wobbling and to distribute forces applied to the seat through the pedestal and into the mounting base. In the preferred embodiment, the engagement member is a plastic sleeve that fits over the guide post. As should be appreciated by those of ordinary skill in the art, use of the guide and engagement members eliminates the need to have tight tolerances between the adjustable post and outer post.

The pedestal has a locking mechanism which interconnects the guide post and the adjustable post. The locking mechanism pulls the adjustable post against the plastic sleeve and the guide post to restrict movement of the adjustable post with respect to the guide post. The intersection between the posts and the sleeve provides a very wide engagement area along the length of each to distribute forces to the base. This is in contrast to the line contact obtained in the traditional telescoping boat seats.

The adjustable post has a longitudinal slot which receives the locking mechanism. In the preferred embodiment, the locking mechanism includes an externally threaded male member and an internally threaded female member which are operatively coupled to interconnect the guide post and the adjustable post.

To further facilitate locking, a secondary engagement member is positioned between the guide post and the adjustable post at the location of the locking member. The secondary member is preferably made of rubber and allows relatively little force to be applied to the locking mechanism to lock the adjustable post in place.

DETAILED DESCRIPTION OF THE INVENTION

Figure 1:
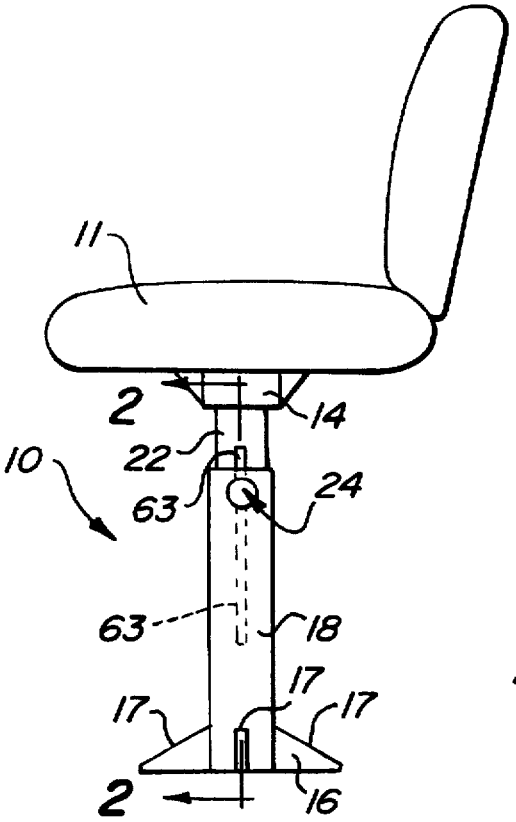
FIG. 1 is a side view of the pedestal of the present invention with the seat mounted to the pedestal.

The pedestal of the present invention is shown generally at 10 in FIG. 1. In the illustration, a boat style seat 11 is mounted through a seat mounting bracket 14 to the pedestal 10. The bracket 14 is preferably a swivel bracket which allows the seat 11 to turn through 360° with respect to the pedestal 10. It should be appreciated by those of ordinary skill in the art that the other brackets could be used.

With reference to FIG. 1, the pedestal 10 includes a mounting base 16 which supports an outer post 18. The disclosed mounting base 16 includes four legs 17 which are welded to the outer post 18. The outer post 18 is preferably an aluminum tube. In the preferred embodiment, the mounting base 16 is secured to the deck of a boat through legs 17.

An adjustable post 22 is telescopically mounted within the outer post 18. This post is preferably an aluminum tube which has an outer diameter that is less than the inner diameter of the outer post 18. By telescoping the post 22 into and out of outer post 18, the height of the seat can be adjusted. A locking mechanism 24 is provided for locking the adjustable post 22 when the desired height has been obtained.

Figure 2:
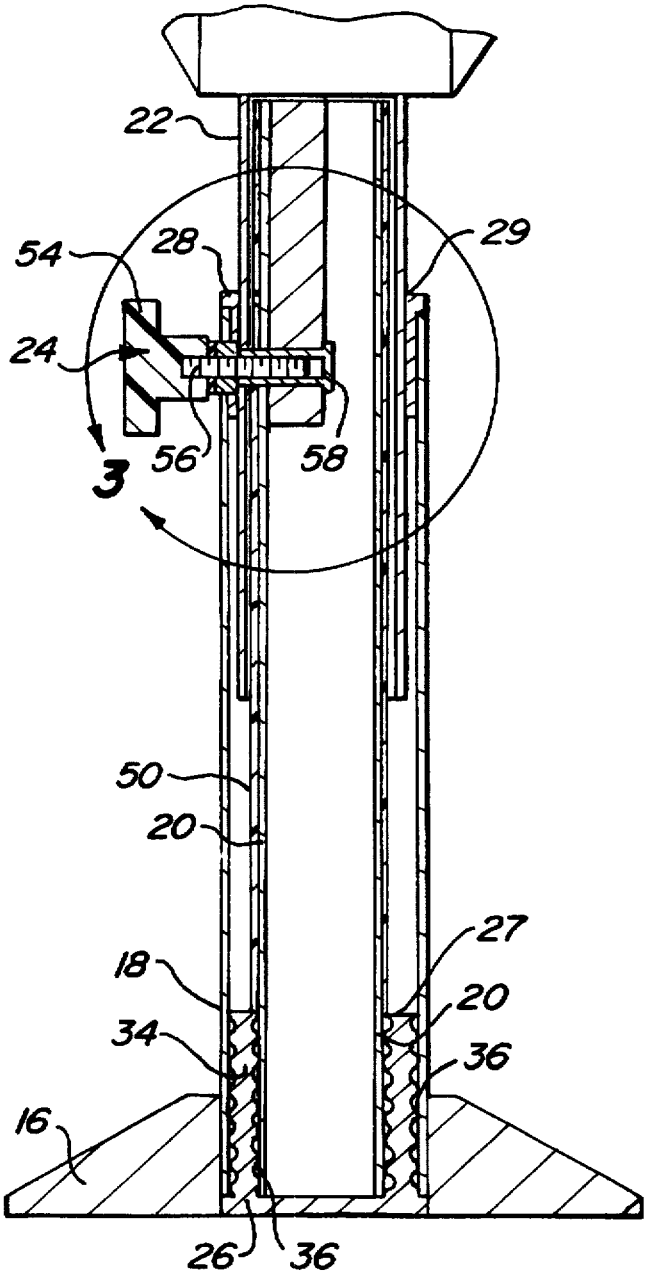
FIG. 2 is a cutaway view of the pedestal of the present invention.

Referring now to FIG. 2, the pedestal 10 includes an inner guide post 20 which is mounted within the outer post 18. Guide post 20 is preferably an aluminum tube. A bottom bushing 26 is press fit into the outer post 18. This bottom bushing 26 has an inner cavity 27 which has an inner diameter that is slightly less than the outer diameter of the guide post 20 so that the guide post 20 is press fit into cavity 27. By press fitting the bushing 26 into the outer post 18 and the guide post 20 into the cavity 27 of the bushing 26, a secure rigid fit is obtained.

A top bushing 28 is press fit into the top open end of outer post 18. This top bushing 28 has an opening 29 through which the guide post 20 extends and the adjustable post 22 is free to reciprocate. In the preferred embodiment, the opening 29 is sufficiently large to allow free movement of the adjustable post 22 into and out of the outer post 18, but narrow enough to provide guidance to the adjustable post 22. As illustrated, the bushing 28 has a flange 31 to facilitate the placement of the bushing 28 within the outer guide post 18.

Figure 5:
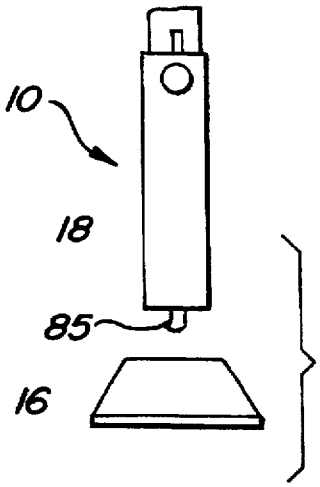
FIG. 5 is a further embodiment of the present invention.

Preferably, the top and bottom bushings 28 and 26 are made of glass impregnated nylon or rubber to provide a rigid bushing for guidance purposes. It is further preferred that the bushings have ridges or ribs 36 along the body portion 34 to ensure that they are secured within the outer post. The ridges 36 are illustrated in FIG. 5. The ridges 36 frictionally engage the interior of the post so that there is a press fit connection between the outer post 18 and the bushings 26 and 28. In this way, the bushings 26 and 28 can be mounted in place without the need for fasteners or adhesives.

Figure 3:
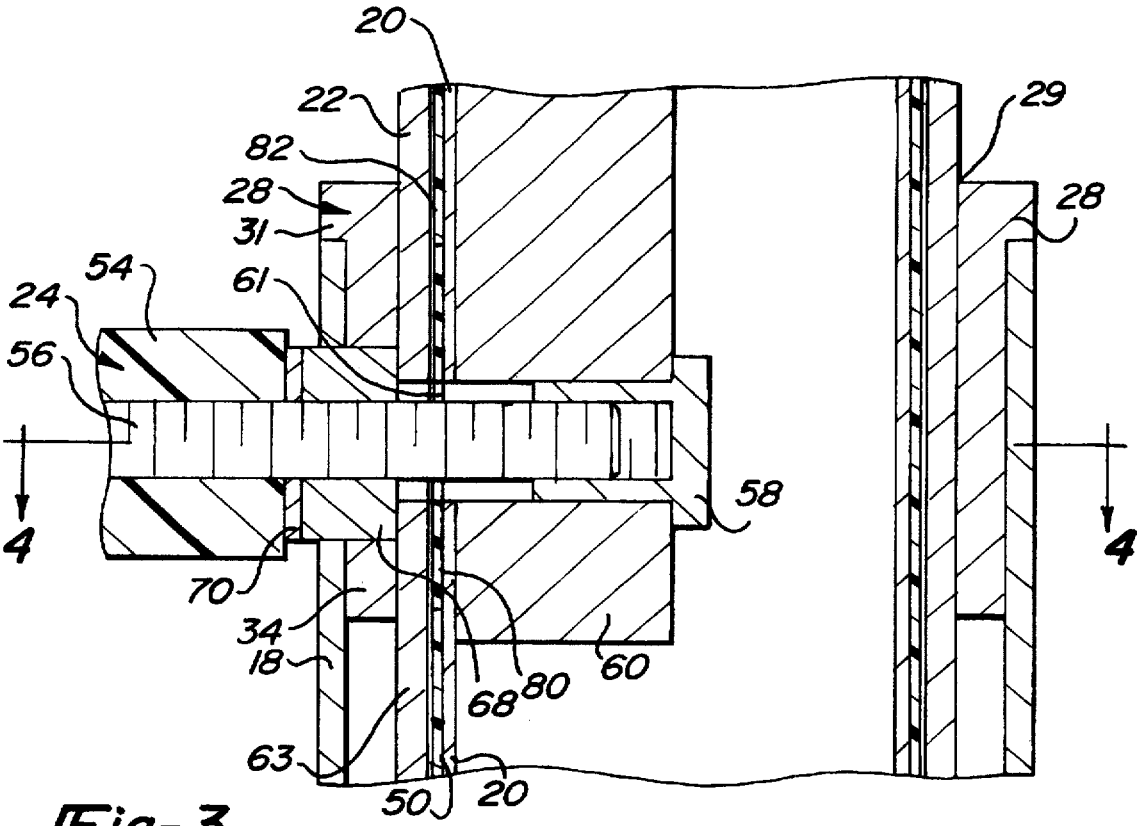
FIG. 3 is an enlarged view of circled area 3 in FIG. 2.
Figure 4:
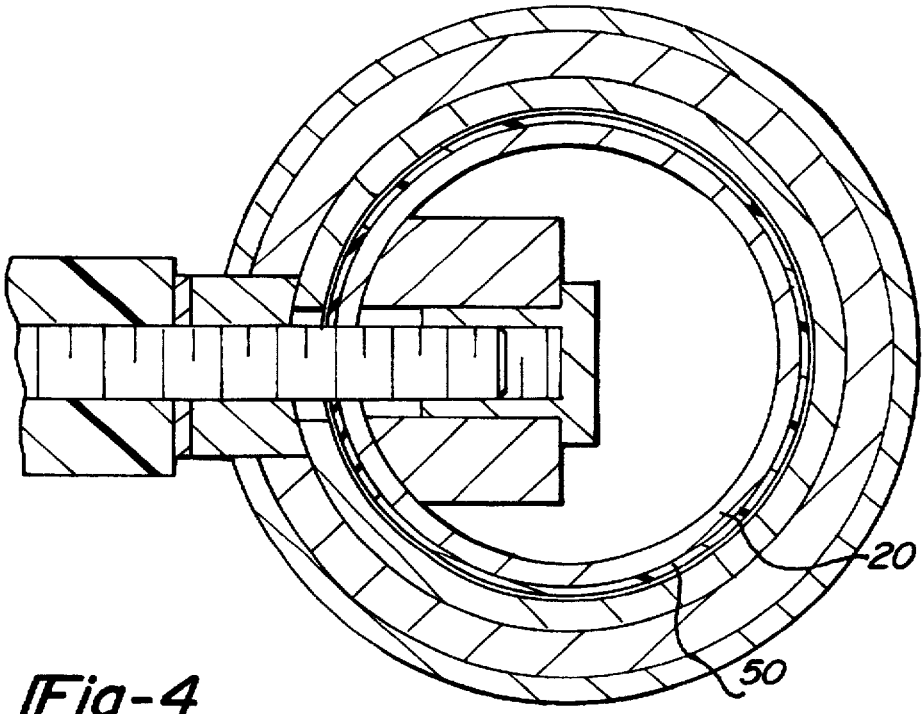
FIG. 4 is a cross-sectional view taken along line 4—4 in FIG. 3.

With reference to FIGS. 2 through 4, a spacer member or engagement member 50 is positioned between the guide post 20 and the adjustable post 22. In the preferred embodiment, the spacer member 50 is a plastic sleeve that fits over the guide post 20. Preferably the spacer member 50 is polyvinyl chloride. It should be understood that the spacer member 50 could be a generally flat piece fitted between the guide post 20 and the adjustable post 22.

In the preferred embodiment, spacer member 50 extends along the entire length of guide post 20. Further, as can be seen, guide post 20 extends out of the outer post 18. This is preferred to allow the adjustable post 22 to contact the guide post 20 and the spacer member 50 above and below the locking mechanism. The spacer member 50 provides a force distribution medium for distributing forces applied to the seat 11 through the adjustable member 22, outer member 18 and base 16. As should be appreciated by those of ordinary skill in the art, the spacer member 50 provides a broad area of contact between the adjustable post 22 and the guide post 20. This eliminates the typical line contact found in traditional adjustable seats. Further, when the locking mechanism 24 is tightened, its forces are being distributed over a greater area making locking much easier than in traditional seats having merely clamping action resulting in line contact. Still further, the interaction of these members also eliminates wobbling. As can be seen in FIG. 2, the adjustable member 22 is contacting the guide post 20 and member 50 both above and below the locking mechanism 24. When the locking member 24 is tightened, the outer post 18 does not have to resist wobbling since wobbling is resisted through the adjustable post 22, guide post 20 and spacer member 50. However, the outer post 18 does transfer the loads to the base 16 through interaction of these members with the bushing 28, guide post 20 and the locking mechanism 24. As should be appreciated, through the interaction of all of these members, wobbling of the seat 11 is virtually eliminated and all forces experienced by the seat and pedestal are directed through large area contacts between the members to the base 16. This reduces wobbling and reduces any adverse effects from continued use and makes locking of the system much easier.

The locking mechanism 24 is designed to provide maximum locking at the desired height with minimum force being applied by the user. The locking mechanism includes a knob 54 which has an externally threaded portion 56 which threads into an internally threaded bushing 58. The bushing 58 is preferably press fit into a locator 60 for locating the bushing 58 with lateral opening 61 in guide post 20. A longitudinal slot 63 is formed in adjustable post 22 to allow post 22 to move with respect to portion 56. (The adjustable slot 63 does not appear in FIG. 3 since a cross-section is being taken through that slot but it can be seen in FIG. 1.) The outer post 18 and the upper bushing 28 both have an opening for receipt of a thrust washer 68 which has a larger diameter than the width of slot 63 and opening 61. The thrust washer 68 engages the outer wall of the adjustable post 22 when knob 54 is tightened to pull the adjustable post 22 into engagement with member 50 and guide 20 and lock the post 22 in place. A washer 70 is positioned between the knob 54 and thrust washer 68.

Positioned adjacent locking member 24 is a secondary engagement member 80. The secondary engagement member is preferably a rubber piece which is inserted into an opening 82 cut into the engagement member 50 adjacent the locking mechanism 24. Rubber is used in the preferred embodiment because of the increased friction provided between the guide post 20 and adjustable post 22. This facilitates the locking of these members together since at the point of locking there is increased frictional engagement between these members. As discussed above, the forces applied are being distributed along the length of all of these members due to the interaction of the members.

In operation, the locking knob 54 is loosened by unscrewing the threaded member 56 with respect to bushing 58. This permits the adjustable member 22 to freely telescope with respect to outer post 18. When the desired height has been obtained, the locking knob 54 is tightened to pull the adjustable post 22 into engagement with engagement member 50 and guide post 20. Again, the secondary engagement member 80 creates additional friction at the locking member to facilitate frictional engagement between these members to prevent the adjustable member 22 from moving with respect to guide member 20. Further, as explained above, any forces applied to seat 11 are then distributed from seat 11 to mounting base 16 through the interaction of the adjustable post 22 engaging the guide post 20 and engagement members 50 and 80, and the interaction of the adjustable post 22 with bushing 28 acting through outer post 18. All of these interactions are then transferred to the bushing 26 which is supporting the guide post 20 and outer post 18 for distribution to mount 16.

With reference to FIG. 5, a modified mounting base and pedestal is illustrated. In this modification, the pedestal 10 is the same as the pedestal previously described except it is removably mounted to mounting base 16. The pedestal 10 has an outer post 18 which includes a key 85 which can be inserted into a complementary opening in mounting base 16 for securement to mounting base 16. The mounting base of FIG. 5 is disclosed in U.S. Pat. No. 5,383,644 issued to the applicant of the present invention on Jan. 24, 1995. Applicant incorporates U.S. Pat. No. 5,383,644 by reference in this Application.

As should be appreciated by those of ordinary skill in the art, the above is a description of the preferred embodiment of the invention, but is not to be read in a limiting way, the invention only being limited by the appended claims.

What is claimed is:

1. A vertically adjustable pedestal for use in mounting a seat for vertical movement with respect to a mounting surface, said pedestal comprising:

mounting means adapted for mounting said pedestal to said mounting surface;

an outer post, said outer post being supported by said mounting means;

a guide post mounted within said outer post, said guide post and said outer post having longitudinal center lines that are generally co-linear;

an adjustable post having first and second ends, said first end having an opening for receipt of said guide post, such that said adjustable post is free to slide with respect to said guide post, said first end also being mounted within said outer post for telescopic movement with respect to said outer post, said second end being adjusted to have a seat mounted thereon;

a locking mechanism for locking said adjustable post at a desired height, said locking mechanism interconnecting said guide post and said adjustable post, said locking mechanism being adapted to draw said guide post and said adjustable post together to restrict movement of said adjustable post with respect to said guide post.

2. The pedestal of claim 1, further including an engagement member mounted between said guide post and said adjustable post to engage said adjustable post.

3. The pedestal of claim 2, wherein said engagement member is a sleeve mounted about said guide post and extending axially along said guide post adjacent said locking mechanism.

4. The pedestal of claim 1, wherein said outer post is a hollow tube and said pedestal includes a top bushing and a bottom bushing pressed into the top and bottom open ends of said outer tube, said bottom bushing having an opening for receipt of said guide post to support said guide post within said outer post, said top bushing having an opening for receipt of said guide post and said adjustable post, said top bushing opening having an inner diameter that is slightly greater than the outer diameter of said adjustable post such that said adjustable post is free to slide within said top bushing but is guided by said guide post and said top bushing.

5. The pedestal or claim 1, wherein said adjustable post has a longitudinal slot which receives said locking mechanism, said locking mechanism extending through said longitudinal slot to engage said guide post.

6. The pedestal of claim 1, further including an engagement medium positioned between said guide post and said adjustable post;

said locking mechanism pulling said guide post and said adjustable post together and into surface-to-surface contact with said engagement medium along a portion of the longitudinal extent of each of said guide post and said adjustable post;

whereby forces on said guide post and said adjustable post are distributed along said engagement medium and said guide post and said adjustable post.

7. The pedestal of claim 6, further including a secondary engagement medium positioned between said guide post and said adjustable post to further distribute forces on said guide post and said adjustable post.

8. The pedestal of claim 1, wherein said locking mechanism includes an externally threaded male member and an internally threaded female member which are operatively coupled to interconnect said guide post and said adjustable post, said locking mechanism being adapted to pull said guide post and said adjustable post together to restrict further movement of said adjustable post with respect to said guide post.

9. The pedestal of claim 8, wherein said locking mechanism include a support means for supporting said internally threaded member within said guide post.

10. The pedestal of claim 8, further including an engagement medium positioned between said guide post and said adjustable post, said locking mechanism being adapted to pull said guide post and said adjustable post together into surface-to-surface contact with said engagement medium along a longitudinally extending portion of said guide post and said adjustable post;

whereby forces on said guide post and said adjustable post are distributed along said engagement medium, said guide post and said adjustable post.

11. A pedestal for supporting a seat, said pedestal comprising;

a telescoping post;

at least one guide post extending into said telescoping post for guiding said telescoping post;

a locking means for locking the telescoping post at a desired height;

a force distribution means for distributing forces applied to said telescoping post, said force distribution means being operatively coupled to said telescoping post, said force distribution means fitted both above and below said locking means to one of said telescoping post and said guide post;

whereby said pedestal can be telescoped to a desired height and locked at said desired height with all forces exerted upon said pedestal being transferred through said telescoping post and said distribution means.

12. The pedestal of claim 11, wherein said force distribution means includes a first distribution member operatively positioned between said guide post and said telescoping post, said first distribution member providing frictional contact between said guide post and said telescoping post, and a second distribution member operatively positioned between said guide post and said telescoping post, said second distribution member providing frictional contact between said guide post and said telescoping post which is different than that provided by said first distribution member.

13. The pedestal of claim 12, wherein said secondary distribution member provides greater frictional resistance to said guide post and said telescoping post than said first distribution member.

14. The pedestal of claim 11, wherein said locking means includes an externally threaded male member and an internally threaded female member which are operatively coupled to interconnect said guide post and said telescoping post, said male and female members being adapted to pull said guide post and said telescoping post together to restrict further movement of said telescoping post with respect to said guide post.

15. A pedestal for supporting a seat, said pedestal comprising:

a telescoping post:

at least one guide post for guiding said telescoping post;

a locking means for locking the telescoping post at a desired height;

a first distribution member operatively positioned between said guide post and said telescoping post, said first distribution member providing frictional contact between said guide post and said telescoping post;

a second distribution member operatively positioned between said guide post and said telescoping post, said second distribution member providing frictional contact between said guide post and said telescoping post which is different than that provided by said first distribution member;

whereby said pedestal can be telescoped to a desired height and locked at said desired height with all forces exerted upon said pedestal being transferred through said telescoping post and said distribution means;

wherein said first distribution member is a sleeve positioned about said guide post and said second distribution member is an insert positioned within said sleeve.

16. The pedestal of claim 15, wherein said sleeve is made of polyvinyl chloride material and said insert is made of rubber.

17. A pedestal for supporting a boat seat within a boat, said pedestal comprising:

a base mounted to said boat;

a telescoping post member;

a guide post mounted to said base and extending into said telescoping post member for guiding said telescoping post member;

a force absorbing means for absorbing and distributing forces applied to said pedestal throughout said pedestal, said force absorbing means being positioned between said guide post and said telescoping post;

a locking mechanism to lock said telescoping member at a desired height, said locking mechanism interconnecting said guide post and said telescoping post member, said locking mechanism exerting force on each of said guide post and said telescoping post member toward each other to restrict movement of said telescoping post with respect to said guide post;

said force absorbing means being squeezed between said guide post and said telescoping post when said locking mechanism locks said telescoping post at a desired height.

18. The pedestal of claim 17, wherein said force absorbing means includes a first distribution member operatively positioned between said guide post and said telescoping post, said first distribution member providing frictional contact between said guide post and said telescoping post, and a second distribution member operatively positioned between said guide post and said telescoping post, said second distribution member providing further frictional contact between said guide post and said telescoping post.

19. The pedestal of claim 11, wherein said locking means includes a first threaded member coupled to said guide post and a complementary second threaded member coupled to said telescoping post, said first and second threaded members interconnecting said guide post and said telescoping post, said first and second members exerting force on said guide post and said telescoping post toward each other to restrict further movement of said telescoping post with respect to said guide post.

* * * * *